US006302764B1

(12) United States Patent
Wirz

(10) Patent No.: US 6,302,764 B1
(45) Date of Patent: Oct. 16, 2001

(54) PROCESS AND DEVICE FOR DRESSING HIGH-SPEED GRINDING WORMS

(75) Inventor: Walter Wirz, Pfaffikon (CH)

(73) Assignee: Reishauer AG, Wallisellen (CH)

( * ) Notice: Subject to any disclaimer, the term of this patent is extended or adjusted under 35 U.S.C. 154(b) by 0 days.

(21) Appl. No.: 09/476,994

(22) Filed: Jan. 4, 2000

(30) Foreign Application Priority Data

Jan. 15, 1999 (DE) ..... 199 01 338

(51) Int. Cl.[7] ..... B24B 49/00

(52) U.S. Cl. ..... 451/11; 451/56; 451/443; 451/253

(58) Field of Search ..... 451/56, 443, 5, 451/9, 10, 11, 47, 147, 213, 219, 253

(56) References Cited

U.S. PATENT DOCUMENTS 4,903,679 * 2/1990 Kiger et al. ..... 451/56
5,076,020 * 12/1991 Negri ..... 451/56
5,738,569 * 4/1998 Mackowsky ..... 451/56

FOREIGN PATENT DOCUMENTS 196 25 370 4/1997 (DE) .
196 19 401 11/1997 (DE) .
197 06 867 8/1998 (DE) .

* cited by examiner

*Primary Examiner*—Eileen P. Morgan
(74) *Attorney, Agent, or Firm*—Sughrue, Mion, Zinn, Macpeak & Seas, PLLC

(57) ABSTRACT

In a first step, the grinding worm profile is dressed according to the requirements of the workpiece that is to be machined. In a second step, the thereby shaped grinding worm, which has been slightly deformed by the effects of the centrifugal force, is measured at operating speed. In a third step, the measured values are converted into control data for a correcting, redressing process of the grinding worm flanks. Finally in a fourth step, the grinding worm flanks are redressed in such a manner that form errors, which are caused by various influences during grinding, are used as correction factors in the machining of the worm profile. The measuring of the grinding worm flanks may be performed directly without contact by means of a distance sensor or indirectly, whereby a sample toothed wheel is ground and this wheel is then measured by means of a tooth-flank measuring machine. The described process makes possible a highly precise tooth-flank grinding process at high grinding worm speed and thereby cost-effective machining is achieved.

9 Claims, 1 Drawing Sheet

PROCESS AND DEVICE FOR DRESSING HIGH-SPEED GRINDING WORMS

BACKGROUND OF THE INVENTION

The continuous generating grinding method of gear teeth has been shown to be a good finishing process also in mass production because of its high efficiency and outstanding constant precision of ground workpieces. In most cases, grinding tools were used in the past that were at the outer circumference gear-worm shaped corundum wheels—the so-called grinding worms—which rarely turned faster than at a speed of approximately 40 m/s at their circumference.

The already very high efficiency of the process may be increased even more if the circumferencial speed of the grinding tool is increased further. The problem thereby is the fact that the grinding worm is deformed by the effect of the centrifugal forces at high speed. Thereby the deformation is not only caused by the complicated stress condition, as it exists in case of a rotating disk, but also by the worm profile, which has at each angle position around the rotational axis a different axial position, whereby an uneven distribution of force is applied to the worm body circumference. Furthermore, the non-homogeneity of the specific gravity and of the modulus of elasticity of the grinding wheel body are also responsible that the grinding worm shape is deformed with increasing speed. A grinding worm rotating at high speed is therefore not only larger in its diameter than the one that is not moving, but it is generally also not round, and the once established worm profile takes on a shape that cannot be predicted in advance. This is however basically true for tools of all grinding machines, only this phenomenon is not a hindrance in cases where the active form of the grinding disk is shaped at a working speed, which means, where the deformations effected by the centrifugal force are eliminated by the dressing process to a certain degree.

Unfortunately, grinding worms are, for obvious reasons, much more difficult to be shaped than grinding disks. In the rule it is therefore necessary to conduct the dressing process at very low speed. Therefor there are a number of processes known wherein the most efficient and currently most widely known process the one with two profiling disks: each profiling disk layered with diamond grains dresses thereby one worm flank in a process, which is similar to the thread cutting process on a lathe. In another more universal method, grinding worm flanks are dressed by making contact at specific points along a line by means of a rotating dressing tool that has a layer of diamond grains at its active outer circumference. This process is performed in such a manner that line after line are placed very close to one another until the entire active flank surface is dressed. This method is however slower than the one mentioned above but it allows—within certain limits—the creation of an arbitrary topology on the worm flanks. For grinding worms shaped in this manner, there is determined in advance a specific assignment of each point of the tooth flanks to be ground to a specific point on the worm flank whereby, during subsequent grinding it must be ensured by relative motion between the tool and workpiece that the respective points are actually touched or are a common meshing point or machining point. Through this method it is possible to manufacture topologically corrected gear teeth by a continuous generating grinding process.

DE-PS 196 19 401 C1 discloses a process by which grinding worms may also be topologically dressed at top grinding speeds. However, this process places high demands on the mechanical device and on the quality of the necessary servo-drives and control systems, which leads in any case to high investment costs. In addition, dressing tools used in this process can only be used for one specific modulus pitch on the grinding worm.

SUMMARY OF THE INVENTION

It is the object of the present invention to disclose a process and a device wherein grinding worms that are operated at high to very high speeds may be dressed (trued) in a known and tested dressing process at low speeds and which have nevertheless the required precise profile geometry at operating speed, which means, at a stressed condition under centrifugal force.

According to the invention, the process comprises the following steps performed sequentially:

1. Dressing of a grinding worm according to a known method in respect to the shape of the tooth flanks of the gear teeth that are to be ground.

2. Measuring the entire grinding worm profile with the grinding worm turning at operating speeds. This measuring may be performed, for example, directly by means of a non-contact measuring system, as by laser optical distance scanning or the like, or it may be performed indirectly by grinding and measuring of a sample (specimen) workpiece. The results of this measuring are in any case a table or a set of data, which contain precise coordinates of surface points that are distributed across the worm flanks matrix-like with sufficient small distances between one another.

3. Conversion of measured data into control data for the dressing device for a correcting, redressing process of the grinding worm profile. This conversion must determine the specified geometry of the grinding worm flank in the first phase on the basis of the specified geometry of the workpiece teeth; whereby in a second phase, the difference must be determined between the specified data of the worm flanks and the measured actual values; and in a third phase, corrected control data must be determined by using the differential values for the necessary movement of the dressing device.

4. The redressing of the grinding worm profile with the newly computed data whereby the previously determined form error is in a way used as a correction factor in dressing the grinding worm so that the grinding worm obtains the desired shape at operating speed.

The measuring of the worm grinding profile at operating speed is of great importance during this process. Should it be measured directly as mentioned above, as it may be performed by laser optical means, for example, then the measuring process may be completed relatively quickly and the data is readily available for further machining. There is a certain difficulty in the relative rough grinding worm flank surface, which requires careful filtering of the measured values when using sensitively reacting measuring devices.

The more costly measuring method is the indirect measuring with a sample workpiece. Thereby a suitable, sufficiently wide sample toothed wheel must be ground in the continuous shift-grinding process, which corresponds to the workpiece relative to the modulus, number of teeth, meshing and pitch angle, and precisely so that the entire grinding worm profile is reproduced on the complete gear teeth width of the sample wheel. This is accomplished if during grinding the entire possible shifting path of the grinding worm is simultaneously run off on the gear teeth width of the sample wheel. Naturally, the specified operating speed of the grinding tool must thereby be maintained.

Tooth flanks of the sample wheel, which are ground in such a manner, contain now in the transformed shape the actual geometry of the grinding worm profile, which means, all form deviations of the tool caused by the centrifugal force, which as mentioned above cannot be predicted, are reproduced on these sample gear teeth. From there, the actual geometry may be taken by any tooth-flank measuring machine.

Even though the second method is more costly than the direct measuring method of the worm profile, it has the great advantage that taken into consideration are not only the geometric distortions of the grinding worm caused by the centrifugal forces, or out-of-round conditions, profile distortions, changes in pitch etc, but also the deviations on the ground tooth flank surface, which are based on the technological influences such as meshing shocks, co-grinding of the tooth root, influence of the cooling lubricant, or even machine errors. In other words, the second method causes the total of all errors during the grinding process and makes possible, according to the described method, the corresponding compensation and elimination of undesired deviations. Thereby, gear teeth may be finished very efficiently and with high precision with a high-speed grinding worm even though the grinding worm was dressed at low speeds.

BRIEF DESCRIPTION OF THE DRAWINGS

In the following there are described two embodiments of the innovative device to perform the above-mentioned process with reference to the drawings, wherein.

DETAILED DESCRIPTION OF THE PREFERRED EMBODIMENTS

Figure 1:
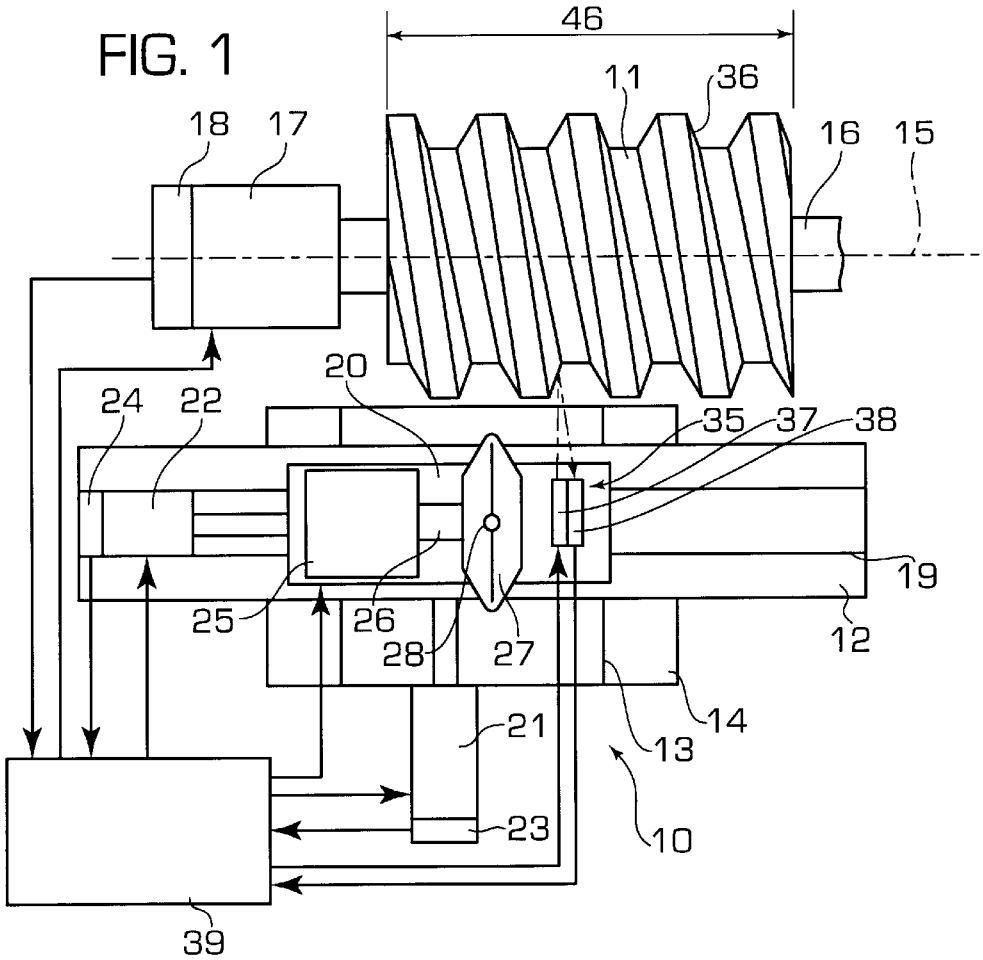
FIG. 1 and FIG. 2 show embodiments for the direct and indirect measuring of the grinding worm, respectively.

FIG. 1 shows a dressing device to dress a grinding worm 11. The dressing device may be designed, for example, according to DE-OS 197 06 867.7. It comprises a cross slide, wherein the first slide 12 may be moved along a guide 13 of a machine base 14 perpendicular to the axis 15 of the grinding spindle 16. The grinding worm 11 is clamped to the spindle 16, which is driven by a motor 17 and is connected to an angle sensor 18. A second slide 20 is movably positioned on top of slide 12 along a guide 19 which is parallel o the axis 15. The sliding movement of each slide 12, 20 is performed by a motor 21, 22, which has a stroke sensor 23, 24. A dressing motor 25 is mounted on slide 20, whereby said motor drives the dressing spindle 26 onto which the dressing disk 27 is clamped. The dressing spindle 26 may be swiveled around an axis 26 which is perpendicular to the direction of guide 13, 19 (see DE-OS 197 06 867.7).

A measuring device 35 for non-contact measuring of both flanks 36 of the grinding worm 11 at full grinding speed is additionally mounted on the slide 20. The device 35 may include, for example, a pulsed laser 37 and a phototransistor 38 with corresponding optics. These two elements 37, 38 of the light-optical, highly precise measuring device 35 are shown in FIG. 1 as they are positioned next to one another. However, the optic may be designed in such a manner that the transmitting impulse is coaxial to the receiving impulse, for example, via a semi-transparent mirror. All servomotors 17, 21, 22, stroke sensors and angle sensors 18, 23, 24, as well as the motor 25 and the measuring device 35 are connected to a control device 39. The functioning of these dressing devices and measuring devices 10, 35 were described above with the aid of processing steps.

Deviating from the illustration according to FIG. 1, for relative motion between the grinding worm 11 and the dressing disk 27, the grinding spindle 16 may be rigidly mounted on the cross slide but instead the dressing spindle 26 may also be rigidly mounted there for this motion. This version has above all an advantage if the grinding worm 11 is moved parallel and perpendicular to axis 15 during grinding of the workpiece. In this case, the same NC-axes of the machine may be used for grinding as well as for dressing, as it is described in DE-OS 196 25 370.5.

Figure 2:
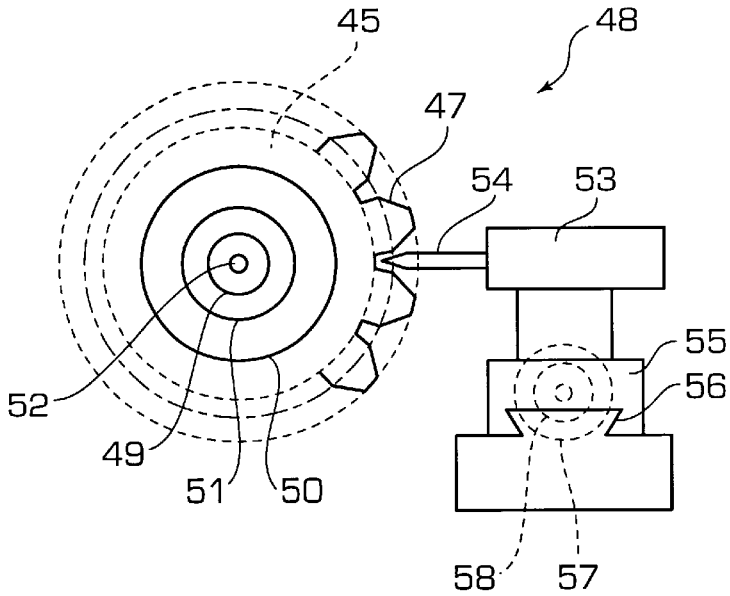

FIG. 2 shows a version for indirect measuring of the grinding worm 11. In this version, a sample toothed wheel 45 is at first ground with the grinding worm 11 at full grinding speed. The sample wheel 45 is preferably wider than the workpieces to be finally ground with the worm 11, and said wheel is ground differently than said workpieces. During grinding of the workpiece, a section of the width 46 of the grinding worm 11 is used for rough-grinding, another section is used for fine-grinding of a number of workpieces, and a third section is used for fine-grinding of yet another number of workpieces. In case of the sample wheel 45, there is, in contrast, a continuous shifting motion performed during grinding parallel to the grinding spindle axis 15 and across the entire width 46 of the worm 11, and at the same time the sample wheel is moved along its axis relative to the grinding worm 11 in such a manner that the entire width of the sample wheel 45 is machined. Thereby, each point of the grinding worm flank 36 has an exactly matching point on the tooth flank 47 of the sample wheel 45. The measuring device 48 for measuring the sample wheel 45 is generally known. For example, suitable for this measuring is the easily obtainable tooth-flank measuring machine with the designation ZP 250, manufactured by the Höfler Company (Firma Höfler). In the illustrated measuring device 48 shown in FIG. 2, the sample wheel is clamped down onto the measuring spindle 49, which may be rotated around the measuring spindle axis 52 by means of a servomotor 50, which has an angle sensor 51. The measuring device 48 may include a measuring tracer 53 with a tracer pin 54, which traces all flanks 47 point by point. The tracer 53 is mounted on a slide 55, which is movable within a guide 56 parallel to axis 52. The slide 55 is moved by a servomotor 57, which has a stroke sensor 58. The motors 50, 57, angle sensor 51 and stroke sensor 58, and the tracer 53 are also connected to the control device 39.

What is claimed is:

1. A process for dressing a grinding worm for grinding a work piece, comprising:

dressing a grinding worm having at least two flanks into a profile required for the manufacture of a work piece rotating said grinding worm at an operating speed, at which said grinding worm will be operated during the manufacture of said work piece;

measuring said dimensions of said grinding worm while said grinding worm is rotated at said operating speed;

converting said measured dimensions of said grinding worm into control data, wherein said control data provides corrections for said at least two flanks on said grinding worm; and redressing said grinding worm in accordance with said control data.

2. A process according to claim 1, wherein during said dressing step said profile is an uncorrected standard profile, which is different from the one needed for the workpiece that is to be ground.

3. A process according to claim 1, wherein measuring of the grinding worm is performed at said operating speed without contact by a distance sensor.

4. A process according to claim 1, wherein measuring of the grinding worm flanks is performed indirectly by means of a sample workpiece, whereby said sample workpiece is ground using a continuous shift-grinding method on said grinding worm, wherein said grinding worm is dressed according to said dressing step, such that an entire active grinding flank geometry is contained on tooth flanks of said sample workpiece; and wherein said sample workpiece is measured with a tooth-flank measuring machine.

5. A device for dressing a grinding worm for grinding, comprising:

a rotable grinding spindle, which rotates around a first axis and onto which a grinding worm having a plurality of flanks is clamped, wherein said grinding spindle is connected to a first motor, said first motor having an angle sensor;

a rotable dressing spindle which rotates around a second axis and is advanceable relative to said grinding spindle radially to the first axis, and moveable in a sliding motion parallel to said first axis, whereby a dressing disk may be clamped onto said rotable dressing spindle, wherein the rotable dressing spindle is driven by a second motor;

a measuring device for measuring the dimensions of grinding worm at operational speed; and a control device for converting values measured with the measuring device into correction values for controlling relative motion between the grinding spindle and the dressing disk to correct at least two flanks of the grinding worm.

6. A device according to claim 5, wherein the measuring device comprises a slidable, non-contact distance sensor, which moves parallel to the first axis relative to the grinding spindle and whereby said distance sensor measures said grinding worm flanks across a full operating width of the grinding worm.

7. A device according to claim 6, wherein said distance sensor is a laser-optical sensor.

8. A device according to claim 6, wherein the distance sensor is mounted adjacent to the dressing disk.

9. A device according to claim 5, wherein the measuring device comprises a measurement unit for measuring a sample wheel ground by the grinding worm.

* * * * *